US006240717B1

(12) United States Patent
Riede

(10) Patent No.: US 6,240,717 B1
(45) Date of Patent: Jun. 5, 2001

(54) FIBER CONDUIT PLATE FOR AN OPEN-END SPINNING DEVICE

(75) Inventor: Brigitte Riede, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/366,125

(22) Filed: Aug. 2, 1999

(30) Foreign Application Priority Data

Aug. 10, 1998 (DE) ..... 198 36 073

(51) Int. Cl.[7] ..... D01H 4/00

(52) U.S. Cl. ..... 57/406; 57/352; 57/404; 57/406; 57/412; 57/413; 57/414; 57/417

(58) Field of Search ..... 57/417, 406, 404, 57/413, 412, 414, 352

(56) References Cited

U.S. PATENT DOCUMENTS

| | | | | |
|---|---|---|---|---|
| 4,471,608 | * | 9/1984 | Kawabata et al. | 57/413 |
| 5,321,943 | * | 6/1994 | Schmid | 57/417 |
| 5,638,671 | * | 6/1997 | Stahlecker et al. | 57/417 |
| 5,768,881 | * | 6/1998 | Lauschke | 57/414 |
| 5,778,654 | * | 7/1998 | Stahlecker | 57/413 |
| 5,794,430 | * | 8/1998 | Grecksch et al. | 57/417 |
| 6,035,623 | * | 3/2000 | Wassenhoven et al. | 57/406 |

FOREIGN PATENT DOCUMENTS

| | | |
|---|---|---|
| 2 038 689 | 1/1973 | (DE) . |
| 196 17 527 A1 | 5/1996 | (DE) . |
| 198 36 073 | 8/1998 | (DE) . |

* cited by examiner

*Primary Examiner*—John J. Calvert
*Assistant Examiner*—Than R Hurley
(74) *Attorney, Agent, or Firm*—Kennedy Covington Lobdell & Hickman, LLP

(57) ABSTRACT

An open-end spinning device (1) with a forwardly-opening vacuum-loaded rotor housing (2), a high speed spinning rotor (3) rotating in the rotor housing and with a fiber conduit plate (4) for closing the rotor housing. The fiber conduit plate (4) has a replaceable conduit-plate adapter (10) forming the mouth area of a fiber guide conduit and a yarn withdrawal jet. The conduit plate adapter (10) is detachably fixed in a receptacle (7) of the fiber conduit plate (4) only in a frictionally connected manner by means of a magnetic coupling (15) which can be easily and rapidly detached when necessary yet is reliable and exact during operation and assembly.

6 Claims, 2 Drawing Sheets

FIBER CONDUIT PLATE FOR AN OPEN-END SPINNING DEVICE

FIELD OF THE INVENTION

The present invention relates to an open-end spinning device having a vacuum-loaded rotor housing with a forward opening, a spinning rotor rotatable at high speed in the rotor housing and fiber conduit plate for closing the forward opening to the rotor housing, the fiber conduit plate having a replaceable conduit-plate adapter comprising the mouth area of a fiber guide conduit and comprising a yarn withdrawal jet, the conduit-plate adapter being detachably fixed in an appropriately designed receptacle of the fiber conduit plate.

BACKGROUND OF THE INVENTION

Open-end spinning devices of the above described type are known, e.g., from German Patent Publication DE 196 17 527 A1. In this spinning device, a pivotably mounted cover element has an annular groove for receiving a lip sealing element and is also formed with a receptacle with conical contact surfaces opening in the direction of the rotor housing in which a correspondingly conical conduit plate adapter is detachably fixed. The precise angular fitting position of the conduit plate adapter is achieved by a positioning device consisting of a centering pin and an arced groove. The maintenance of the prescribed angular position of the conduit plate adapter in the fiber conduit plate can be monitored via a monitoring device. In the assembled state the conduit plate adapter, aligned in a precise angular manner by the centering pin, rests by its conical contact surface on the correspondingly formed conical contact surface of the receptacle and is loaded thereby with a holding force acting in axial direction via jointly acting, positive fastening means and frictionally connected or frictionally engaged means.

In this known device, the described type of fastening is disadvantageous. In order to replace the conduit plate adapter, in addition to disengaging the frictionally connected means, e.g., a magnetic coupling, the positive fastening means, e.g., designed as a threaded connection or bayonet catch and cooperating with the magnetic coupling, must always be disengaged, using a special tool if necessary.

SUMMARY OF THE INVENTION

In view the state of the art described above, it is an objective of the present invention to provide a simplified and therewith improved fastening means for conduit plate adapters.

The present invention achieves this objective by providing an exclusively non-positive, i.e., frictionally connected, means of fastening of the conduit plate adapter detachably to the fiber conduit plate in an open-end spinning device. More specifically, the present invention is adapted to an open-end spinning device basically comprising a rotor housing defining a forward opening, a spinning rotor rotatable in the rotor housing, and a fiber conduit plate for closing the forward opening of the rotor housing, and particularly an open-end spinning device wherein the fiber conduit plate defines a receptacle for detachably receiving a replaceable conduit plate adapter which, e.g., may comprise a mouth area of a fiber guide conduit and comprises a yarn withdrawal jet. According to the present invention, a magnetic coupling is provided for exclusively frictionally connected fastening of the conduit plate adapter detachably to the fiber conduit plate.

Such a design in accordance with the present invention results in a simple fixing of the conduit plate adapter which can be easily and rapidly released for detachment and replacement of the conduit plate adapter, yet is very reliable and exact during operation and assembly.

In a preferred embodiment, the magnetic coupling comprises at least one permanent magnet fixed to or fitted into either the fiber conduit plate or the conduit plate adapter and a preferably disk-shaped ferromagnetic structural component arranged on the other thereof for cooperating therewith for a frictionally connected magnetic connection therebetween, preferably acting in the direction axially with respect to the fiber conduit plate and the conduit plate adapter. Preferably, two symmetrically arranged, disk-shaped permanent magnets or, advantageously, also a centrally arranged ring magnet, are permanently anchored in the fiber conduit plate or in a structural element connected to the fiber conduit plate. The associated ferromagnetic structural components, e.g., a steel ring or two appropriately symmetrically arranged steel disks are preferably positioned in such a manner in the conduit plate adapter that the permanent magnets and the ferromagnetic structural components face opposite each other in the assembled state while maintaining a slight air gap therebetween. This air gap assures a precise axial fitting position of the conduit plate adapter since it is thereby assured that the conduit plate adapter always is supported in the area of its conical contact surface.

In a further advantageous development of the invention, a positioning device arranged between the fiber conduit plate and the conduit plate adapter assures a necessary, precise angular fitting position of the conduit plate adapter. The use of an ejector for the conduit plate adapter is also advantageous.

In addition to an economical manufacture, the subject matter of the invention combines in an advantageous manner a simple and easy manipulation with high operational safety and a reliable and exact fixing of the conduit plate adapter in the receptacle of the fiber conduit plate. The design of a purely frictionally connected, detachable fastening means in accordance with the invention overcomes the prevailing conventional wisdom that a purely frictionally connected fastening of the conduit plate adapter in this type of open-end spinning application does not offer sufficient operational safety, which conventional wisdom has accordingly resulted in the known combination of frictionally connected and positive fastenings.

Further details, features and advantages of the present invention will be understood from the following description of exemplary embodiments with reference to the accompanying drawings.

DETAILED DESCRIPTION OF THE PREFERRED EMBODIMENT

Figure 1:
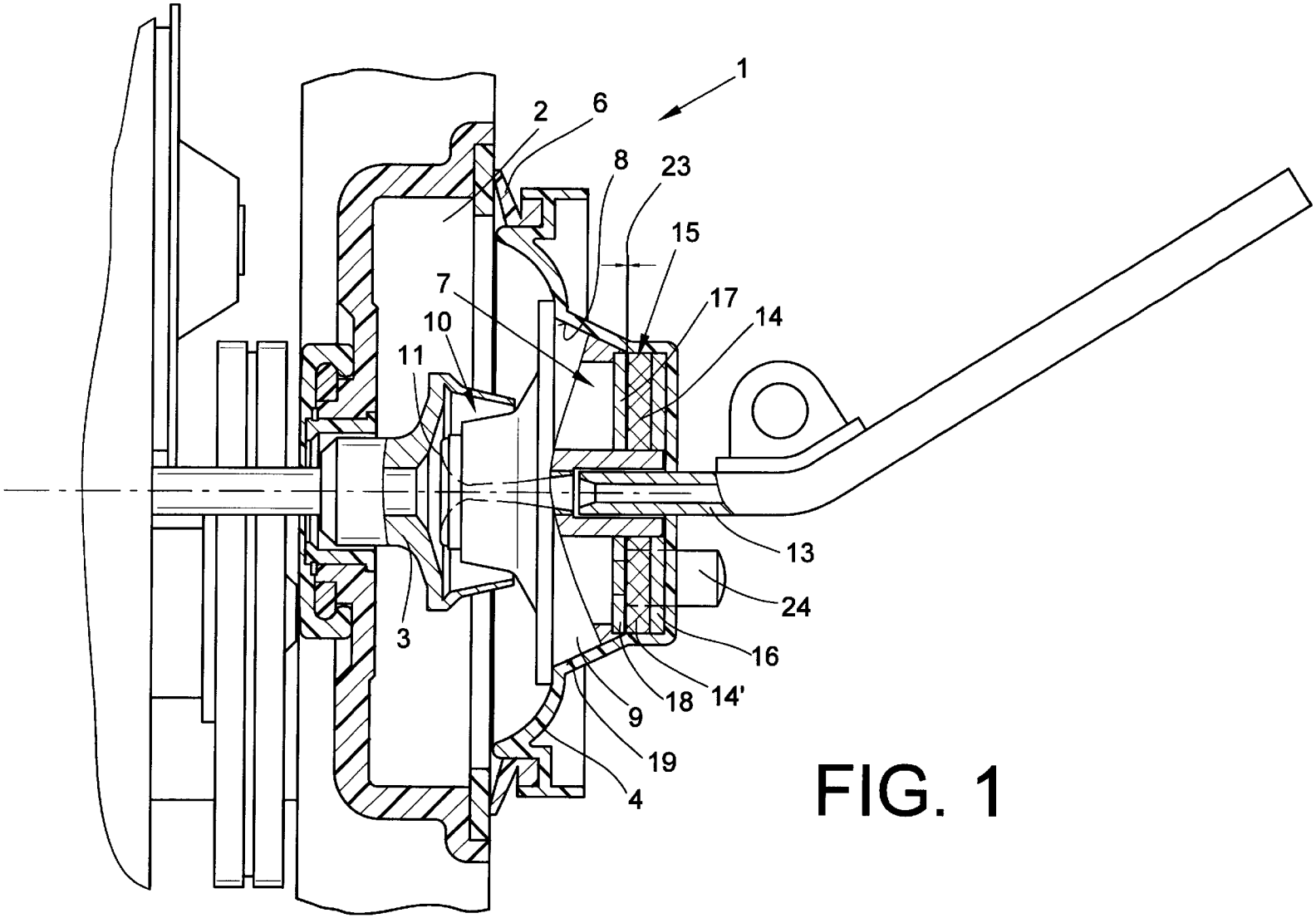
FIG. 1 is a side elevational view, partially in axial cross-section, of a portion of an open-end spinning device having a preferred embodiment of a detachable magnetic fastening means for the conduit plate adapter in accordance with the present invention.

Referring now to the accompanying drawings and initially to FIG. 1, an open-end spinning device 1 is shown in partial section and basically comprises, as is known, rotor housing 2 in which spinning rotor 3 rotates at a high speed. Rotor housing 2, which is open to the front, is closed over such forward opening during operation by fiber conduit plate 4 of cover element 5. Fiber conduit plate 4 is fastened as a separate structural component to cover element 5, but can also be directly integrated into cover element 5.

Fiber conduit plate 4 has an outer annular shoulder or rim for receiving lip sealing element 6 and an inner receptacle 7 open in the direction of rotor housing 2. The receptacle 7 has a conical lateral contact surface 8.

Figure 3:
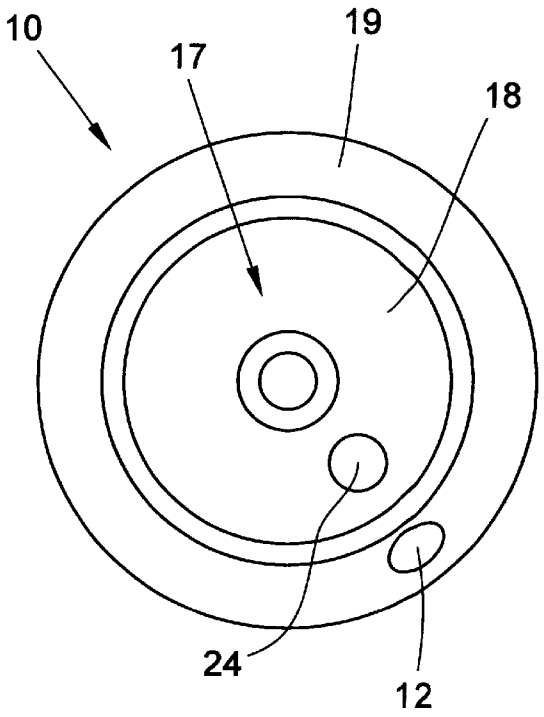
FIG. 3 is a rear elevational view of the conduit plate adapter removed from FIG. 2.

Conduit plate adapter 10 has a support body 9 fastened in receptacle 7 by means of magnetic coupling 15 in such a manner that conduit plate adapter 10 can be aligned at the precise angle and readily detached. Conduit plate adapter 10 has a central bore for yarn withdrawal jet 11 and a lateral bore for mouth area of fiber guide conduit 12, shown in FIGS. 2 and 3. Yarn withdrawal tube 13 follows yarn withdrawal jet in the direction of yarn withdrawal.

As clearly shown in FIG. 1 and apparent to one having ordinary skill in the art, the rotor 3 has a rotor cup 70 including a fiber sliding surface 72 in its hollow interior 74 that extends conically from the open front side of the rotor cup 70 to a fiber collecting groove 76. The fiber collecting groove 76 forms the largest diameter of the interior 74 of the rotor cup 70, and during operation the individual fibers are fed into the rotor cup 70 and are deposited in the fiber collecting groove 76. The fiber conduit plate 4 of the cover element 5 further includes the conduit plate adapter 10 (when secured to the fiber conduit plate 4 as set forth below) projecting through the open front side of the rotor cup 70 to within close proximity of the fiber collecting groove 76. Furthermore, the conduit plate adapter 10 and the rotor cup 70 define therebetween an overflow gap 78 for escape of the necessary spinning air which is supplied through a fiber feed channel in a known way and serves to transport the separated fibers to the fiber sliding surface 72 of the rotor cup 70.

Conduit plate adapter 10 comprises connection means 17 on its side opposite yarn withdrawal jet 11. Connection means 17 is preferably in the form of a ferromagnetic, annular disk 18 which is fitted firmly into support body 9 of conduit plate adapter 10, which is manufactured, e.g., of aluminum or plastic.

Support body 9 of conduit plate adapter 10 has a conical contact surface 19 which is fixed in abutment with the correspondingly conical contact surface 8 of receptacle 7 when the conduit plate adapter 10 is mounted into the fiber conduit plate 4. Ejector pin 24 is fastened to disk 18 and extends partially outward through opening 25 of fiber conduit plate 4 to make it possible for conduit plate adapter 10 to be readily detached in a simple manner from fiber conduit plate 4.

The precise angular fitting position of conduit plate adapter 10 can be readily achieved with positioning device 20 (shown in FIG. 2), comprising centering pin 21 fitted into the adapter 10 and a corresponding bore 22 formed in bearing disk 16 which is fixed in the bottom of receptacle 7 of the conduit plate 4.

Figure 2:
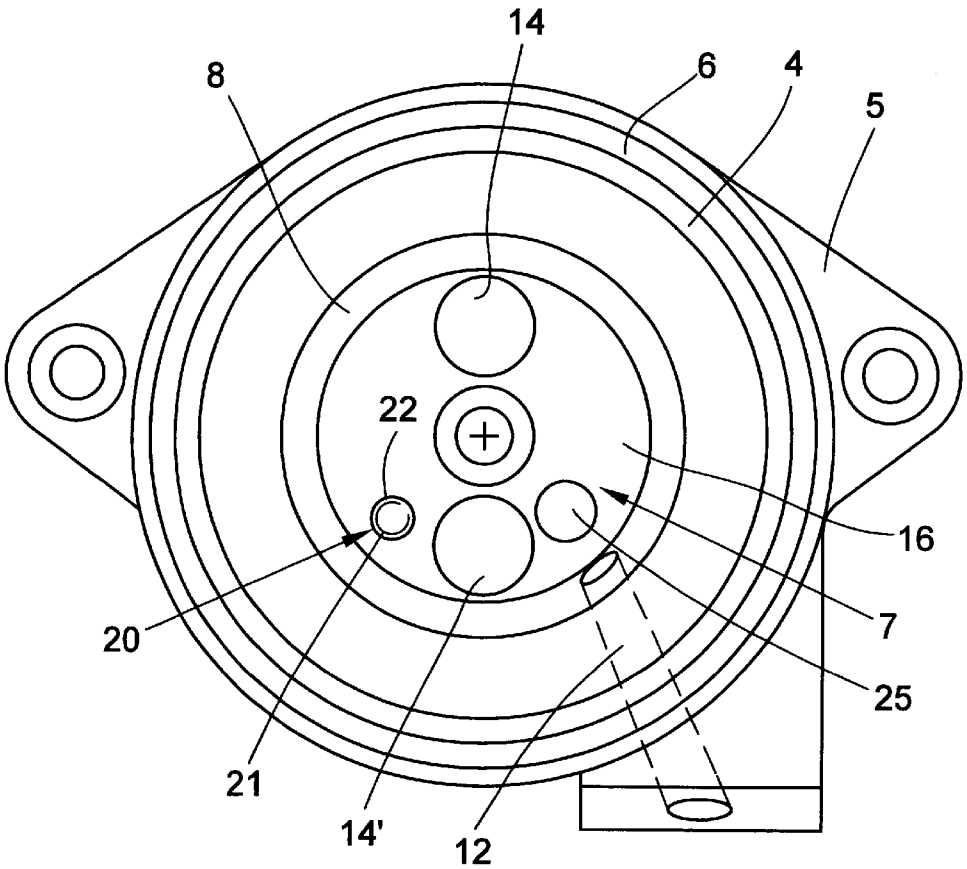
FIG. 2 is an axial elevational view of the receptacle of the fiber conduit plate in the open-end spinning device of FIG. 1, shown with the conduit plate adapter removed.

As shown in FIG. 2, two disk-shaped permanent magnets 14, 14' are symmetrically arranged in the bottom of receptacle 7 and permanently anchored to fiber conduit plate 4 via bearing disk 16, which reinforces the magnetic effect. The associated ferromagnetic (preferably steel) disk 18 forms a structural component of the support body 9 of the conduit plate adapter 10 positioned thereon such that, when assembled with the fiber conduit plate 4, permanent magnets 14, 14' and the ferromagnetic disk 18 are opposite each other at a slight spacing forming air gap 23. Air gap 23 is 0.1 to 0.2 mm which assures that conduit plate adapter 10 always rests with conical contact surface 19 of its bearing body 9 on the correspondingly conical contact surface 8 of receptacle 7 of fiber conduit plate 4 and further assures that a magnetic force is active between the components which is sufficiently great to reliably hold conduit plate adapter 10 in this fitted position during operation as well as during the opening and closing of cover element 5. Ejector 24 shown in FIG. 3 in the rear view of conduit plate adapter 10 is permanently connected to conduit plate adapter 10 at a location such that it projects through opening 25 (whose position is shown in FIG. 2) outwardly of the outer surface of fiber conduit plate 4 in this assembled condition. The conduit plate adapter 10 may thus be readily detached from fiber conduit plate 4 by simply exerting sufficient manual pressure on ejector 24 to overcome the frictionally connected magnetic connection and then lifting up the adapter 10 from the conduit plate 4.

The invention is not limited to the exemplary embodiments shown. Permanent magnets 14, 14' can be fitted directly into the housing of fiber conduit plate 4 instead of into bearing disk 16. It is also quite possible to exchange the arrangement of the components of magnetic coupling 15 and, e.g., arrange permanent magnets 14, 14' on conduit plate adapter 10 and ferromagnetic disk 18 on fiber conduit plate 4.

The described design in accordance with the invention makes it possible to replace conduit plate adapter 10 without threaded connection and the associated screwing motion and without a bayonet catch and the associated rotating motion, as a result of which the replacement of conduit plate adapter 10 takes place more simply and, in particular, more rapidly. Thus, it is also not necessary to use special tools to produce a rotary attaching and detaching motion. The removal of conduit plate adapter 10 out of the fitting position takes place solely by overcoming the frictionally connected magnetic connection.

Structural components and working processes, especially threaded parts and the production of threads, are saved during the manufacture of the fiber conduit plate 4 and conduit plate adapter 10 in accordance with the invention. Positioning device 20 can also be designed in a more simple manner since the elimination of the rotary motion conventionally necessary for attaching and detaching of conduit plate adapter 10 enables a simple bore to suffice for receiving a centering pin in conduit plate adapter 10 instead of an arced groove. Fiber conduit plate 4 of the invention can thus be manufactured more economically.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device, comprising:

(a) a rotor housing defining a forward opening, (b) a spinning rotor rotatable within the forward opening of the rotor housing and including a rotor cup having a fiber sliding surface defining a hollow interior of the rotor cup and extending conically from an open front side of the rotor cup to a fiber collecting groove thereof for deposit of fibers therein during spinning, (c) a fiber conduit plate connected to the rotor housing and covering the forward opening of the rotor housing, and (d) a conduit plate adapter connected to the fiber conduit plate and comprising a mouth area of a fiber guide conduit and a yarn withdrawal jet, the conduit late adapter projecting through the open front side of the rotor cup to within close proximity to the fiber collecting groove and defining exclusively therebetween an overflow gap for escape of spinning air from the rotor cup, the conduit plate adapter being secured to the fiber conduit plate only by a magnetic coupling for exclusively frictionally connected fastening of the conduit plate adapter detachably to the fiber conduit plate.

2. The open-end spinning device according to claim 1, characterized in that the magnetic coupling comprises at least one permanent magnet on one of the fiber conduit plate and the conduit plate adapter and a ferromagnetic disk-shaped structural component on the other thereof for attraction by the at least one permanent magnet to form a non-positive frictional connection therebetween, the at least one permanent magnet and the disk-shaped structural component being arranged for application of the non-positive frictional magnetic connection in a direction axially of the fiber conduit plate and the conduit plate adapter.

3. The open-end spinning device according to claim 2, characterized by a spacing of at least about 0.1 mm between the ferromagnetic structural component and the at least one permanent magnet when the conduit plate adapter is received within the receptacle of the fiber conduit plate.

4. The open-end spinning device according to claim 2, characterized in that the at least one permanent magnet and the ferromagnetic structural component are arranged to exert therebetween a frictionally connected magnetic force which is a multiple of the forces of acceleration and of inertia which maximally occur during the opening and closing of the fiber conduit plate.

5. The open-end spinning device of claim 1, wherein the fiber conduit plate defines a conical recess within which the conduit plate adapter is secured by the magnetic coupling.

6. The open-end spinning device of claim 1, wherein the fiber conduit plate is pivotally connected to the rotor housing.

* * * * *